US009279599B2

(12) United States Patent
Lee

(10) Patent No.: US 9,279,599 B2
(45) Date of Patent: Mar. 8, 2016

(54) HEATING UNIT AND HEATING SYSTEM USING THE SAME

(71) Applicant: LITE-ON IT CORPORATION, Taipei (TW)

(72) Inventor: Yung-Lung Lee, Hsinchu (TW)

(73) Assignee: Lite-On Technology Corporation, Taipei (TW)

( * ) Notice: Subject to any disclaimer, the term of this patent is extended or adjusted under 35 U.S.C. 154(b) by 296 days.

(21) Appl. No.: 13/950,225

(22) Filed: Jul. 24, 2013

(65) Prior Publication Data

US 2014/0301726 A1 Oct. 9, 2014

(30) Foreign Application Priority Data

Apr. 7, 2013 (CN) ..... 2013 1 0116992

(51) Int. Cl.

| | |
|---|---|
| ***F24H 1/10*** | (2006.01) |
| ***F24H 3/04*** | (2006.01) |
| ***F24H 9/18*** | (2006.01) |
| ***H05B 3/26*** | (2006.01) |

(52) U.S. Cl.

CPC ..... *F24H 3/0405* (2013.01); *F24H 9/1863* (2013.01); *H05B 3/262* (2013.01)

(58) Field of Classification Search

None

See application file for complete search history.

(56) References Cited

U.S. PATENT DOCUMENTS

| | | | | | |
|---|---|---|---|---|---|
| 3,215,817 | A * | 11/1965 | Peek | H05B 3/00 | 219/432 |
| 4,162,395 | A * | 7/1979 | Kobayashi | F24H 3/0405 | 219/504 |
| 4,321,456 | A * | 3/1982 | Ohnmacht | H05B 3/16 | 219/532 |
| 4,703,153 | A * | 10/1987 | Pelonis | F24H 3/0417 | 219/505 |
| 4,717,813 | A * | 1/1988 | Berg | H05B 3/141 | 219/202 |
| 5,028,763 | A * | 7/1991 | Chung-Tai | H05B 3/30 | 219/505 |
| 5,125,070 | A * | 6/1992 | Chung-Tai | H05B 3/30 | 219/505 |
| 5,202,547 | A * | 4/1993 | Abe | B01J 35/0033 | 219/205 |
| 5,239,163 | A * | 8/1993 | Brouwers | F24H 3/0405 | 165/185 |
| 5,243,683 | A * | 9/1993 | Yang | A45D 20/12 | 165/183 |
| 5,377,298 | A * | 12/1994 | Yang | H05B 3/148 | 219/504 |
| 5,452,181 | A * | 9/1995 | Hoover | H01L 23/4093 | 165/80.3 |
| 5,521,357 | A * | 5/1996 | Lock | H05B 3/262 | 219/541 |

(Continued)

*Primary Examiner* — Thor Campbell

(57) ABSTRACT

A heating system is disclosed, which includes a main body having a duct formed therein, an air flowing guiding member, and a heating unit. The duct has an air inlet and an air outlet. The air flowing guiding member is disposed in the duct. The heating unit includes a substrate and a plurality of electronic components disposed on the substrate in a matrix form and embossed from a surface of the substrate, wherein each of the electronic components is capable of individually producing heat to directly heat up the air flowing in the duct. Also a heating system using the heating unit is disclosed.

12 Claims, 2 Drawing Sheets

(56) References Cited

U.S. PATENT DOCUMENTS 5,641,420 A * 6/1997 Peterson ..... F24H 3/0405 219/536
5,665,261 A * 9/1997 Damsohn ..... B60H 1/2225 219/202
5,805,767 A * 9/1998 Jouas ..... G05D 23/1902 219/506
5,854,471 A * 12/1998 Tadokoro ..... F24H 3/0429 219/505
6,172,343 B1 * 1/2001 Nothe ..... H05B 1/0277 219/480
6,175,688 B1 * 1/2001 Cassidy ..... A61M 5/44 392/470
6,285,004 B1 * 9/2001 Arold ..... B60H 1/0005 165/41
7,977,607 B2 * 7/2011 Colette ..... F24H 3/0405 165/148
8,637,796 B2 * 1/2014 Bohlender ..... B60H 1/2221 219/202
8,948,582 B2 * 2/2015 Kominami ..... F24H 9/20 165/175
9,029,740 B2 * 5/2015 Aguilar ..... B23K 1/012 219/482
2002/0100753 A1 * 8/2002 Johnsgard ..... H01L 21/67103 219/468.1
2002/0195441 A1 * 12/2002 Kariya ..... H05B 3/12 219/466.1
2004/0020687 A1 * 2/2004 Moore ..... H05K 1/0212 174/254
2004/0228646 A1 * 11/2004 Sekiguchi ..... G03G 21/206 399/92
2007/0023411 A1 * 2/2007 Angelis ..... B60H 1/00471 219/202
2007/0215329 A1 * 9/2007 Schwab ..... H05K 7/20918 165/122
2008/0217324 A1 * 9/2008 Abbott ..... C23C 4/06 219/538
2013/0180973 A1 * 7/2013 White ..... H05B 3/28 219/209
2014/0355966 A1 * 12/2014 Pierron ..... B60H 1/2221 392/360

* cited by examiner

HEATING UNIT AND HEATING SYSTEM USING THE SAME

CROSS REFERENCE TO RELATED APPLICATIONS

This Application claims priority of China Patent Application No. 201310116992.X, filed on Apr. 7, 2013, the entirety of which is incorporated by reference herein.

BACKGROUND OF THE INVENTION

1. Field of the Invention

The present invention relates to an electronic component of a heating system, and more particularly, to a heating unit of a heating system.

2. Description of the Related Art

In order to measure particular values to determine if a person is at risk of disease, the whole blood or serum of a human is reacted with a chemical reagent to perform chemical reactions in a medical apparatus. Since the chemical reaction and chemical activity are directly affected by reacting temperature, a temperature control system is required in the medical apparatus so as to improve accuracy of the measured values. Additionally, due to the fact that the normal environmental temperature, especially in a place where the medical apparatus is used, is below 37° C., a temperature control system is generally configured to produce heat to facilitate the chemical reaction.

The conventional temperature control system generally includes a resistive heating plate and heat dissipating fins which are formed by aluminum extrusion type. The heating plate may be formed by silicon resin, PET, high temperature stable mica, or polyimide film, and the heating plate is attached to a flat surface of the heat dissipating fins. While operating, heat generated from the heating plate is conducted to the heat dissipating fins and transferred to air that is to be heated. However, the temperature distribution on the heat dissipating fins is not uniform (the region near the heating plate has higher temperatures, and the region away from the heating plate has lower temperatures) thereby decreasing heat exchange efficiency.

Thus, a need exists for a heating unit which has high heat exchange efficiency and low manufacturing costs.

BRIEF SUMMARY OF THE INVENTION

In this regard, the disclosure provides a heating unit, in which a contacting area between the heating source and the air that is to be heated is increased so as to improve the heat exchange capacity in a unit volume of the heating system.

According to one embodiment of the disclosure, the heating unit comprises a substrate and a plurality of electronic components. The plurality of electronic components is disposed on the substrate in a matrix form and embossed from a surface of the substrate, wherein each of the electronic components is capable of individually producing heat to directly heat up air around the electronic components.

In the above embodiment, the substrate comprises a printed circuit board and has a first edge and a second edge opposite to the first edge, and the plurality of electronic components is arranged on the printed circuit board along a direction from the first edge to the second edge. Additionally, the plurality of electronic components has different heating powers, and along the direction from the first edge to the second edge the heating powers increase.

In the above embodiment, the plurality of electronic components has different heating powers, and along the direction from the first edge to the second edge the heating powers are adaptively adjusted according to heating requirements.

In the above embodiment, the plurality of electronic components is resistor elements and disposed on the substrate in an erected manner. Alternatively, the plurality of electronic components is disposed on the substrate in a lying manner The disclosure also provides a heating system, which includes a main body having a duct, an airflow guiding member, and any one of the heating units.

In the above embodiment, the duct comprises a sidewall located between the airflow guiding member and the air outlet, and an opening is disposed on the sidewall, wherein the plurality of electronic components is disposed into the duct via the opening.

In the above embodiment, the substrate comprises a printed circuit board and has a first edge and a second edge, wherein the second edge is close to the air outlet relative to the first edge, and the plurality of electronic components is arranged on the printed circuit board along a direction from the first edge to the second edge.

In the above embodiment, the plurality of electronic components has different heating powers, and along the direction from the first edge to the second edge the heating powers increase.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the contemplated mode of carrying out the invention. This description is made for the purpose of illustrating the general principles of the invention and should not be taken in a limiting sense. The scope of the invention is determined by reference to the appended claims.

Figure 1:
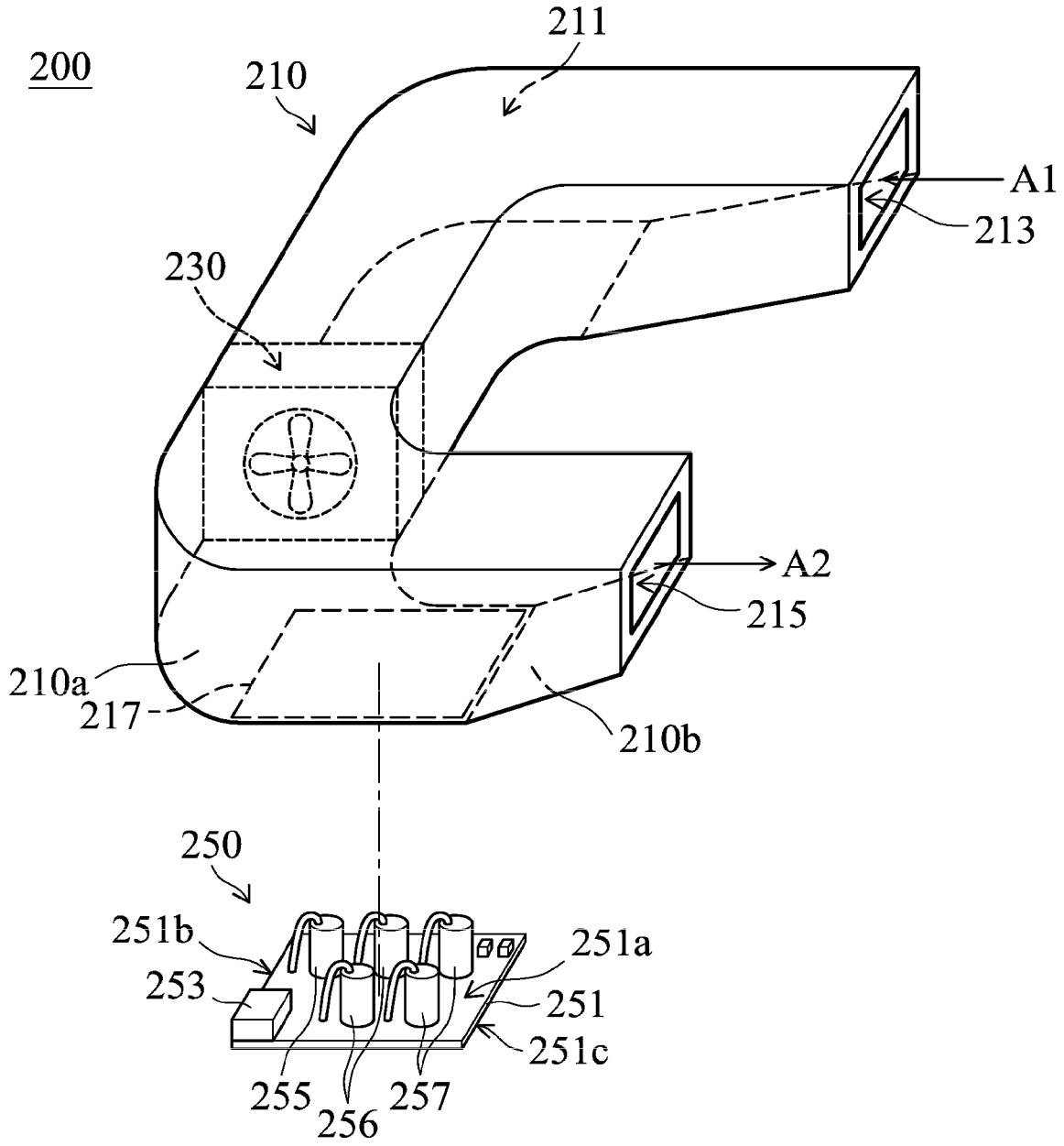
FIG. 1 shows an explosive view of a heating system of one embodiment of the disclosure.

Referring to FIG. 1, which shows an explosive view of a heating system 200 of one embodiment of the disclosure. The heating system 200 includes a main body 210, an airflow guiding member 230, and a heating unit 250. The main body 210 has a hollowed duct 211, and the duct 211 includes an air inlet 213 and an air outlet 215. In the embodiment the main body 210 is a substantially U-shaped, and the air inlet 213 and the air outlet 215 are disposed on the same side of the heating system 210. Namely, the air inlet 213 and the air outlet 215 are disposed on two ends of the U-shaped main body 210. Additionally, as shown in FIG. 1 the main body 210 has an opening 217 disposed on a sidewall 210*a* located at a bottom side of the duct 211 adjacent to the air outlet 215.

The airflow guiding member 230 is a fan assembly and disposed in the duct 211 for activating the air in the duct 211 to flow. As shown in FIG. 1, a width of the fan assembly 230 is the same as that of a width of the duct 211 in a sectional direction, whereby enhancing the efficiency of the fan assembly 230. It is appreciated that while in the embodiment the air guiding member 230 is a fan assembly, it should not be limited thereto. In other embodiments, the airflow guiding member may also include other devices such as a pump etc. to activate the air.

The heating unit 250 includes a substrate 251, a connector 253, and a plurality of electronic components 255, 256 and 257. In the embodiment, the substrate 251 is a printed circuit board. For the purpose of illustration, the printed circuit board 251 refers to the substrate in the following descriptions. The connector 253 is disposed in the printed circuit board 251 and connected to an external power source (not shown) to provide power for the plurality of electronic components 255, 256 and 257. The plurality of electronic components 255, 256 and 257 is disposed on the printed circuit board 251 in a matrix form and embossed from a surface 251*a* of the printed circuit board 251, wherein the electronic components 255, the electronic components 256 and the electronic components 257 have different heating powers, respectively.

Specifically, as shown in FIG. 1, the plurality of electronic components 255, 256 and 257 is respectively resistor elements and disposed on the printed circuit board 251 in an erected manner, wherein the plurality of electronic components 255, 256 and 257 is arranged on the printed circuit board 251 along a direction from a first edge 251*b* to a second edge 251*a* of the printed circuit board 251. While assembling the heating unit 250 and the duct 211, a surface 251*a* of the printed circuit board 251 where the plurality of electronic components 255, 256 and 257 is disposed faces the duct 211 so as to allow the plurality of electronic components 255, 256 and 257 to be inserted into the duct 211 via the opening 217.

The operating method of the heating system 200 is illustrated hereinafter. To operate the heating system 200, the connector 253 of the heating unit 250 is connected to an external power source (not shown) such that the plurality of electronic components 255, 256 and 257 is capable of individually producing heat to directly heat up air around the plurality of electronic components 255, 256 and 257. Next, the airflow guiding member 230 is driven to activate the cold air flow A1 flowing into the duct 211 via the air inlet 213 of the duct 211 and flowing through the plurality of electronic components 255, 256 and 257 to exchange heat energy generated from the plurality of electronic components 255, 256 and 257. Then, the heated and warm air flow A2 is exhausted via the air outlet 215 to an exterior of the heating system 200.

Because the plurality of electronic components 255, 256 and 257 is disposed on the printed circuit board 251 in an erected manner, the contact area between the plurality of electronic components 255, 256 and 257 and the air flow is effectively increased whereby increasing heat exchange capacity. It is noted that with a decrease of the temperature difference between the plurality of electronic components 255, 256 and 257 and the air flow, heat exchange efficiency decreases. In order to maintain heat exchange efficiency thereof, in the embodiment, the heating power of the electronic components 257 is larger than that of the electronic components 256, and the heating power of the electronic components 256 is larger than that of the electronic components 255. Thus, the temperature differences between the plurality of electronic components 255, 256 and 257 and the air flow is maintained, and the air flow may be heated to a desired temperature. It is appreciated that the amount of the electronic components 255, 256 and 257, the arrangement of the electronic components 255, 256 and 257, and the variation of the heat powers of the electronic components 255, 256 and 257 should not be limited to the embodiments. A person with average knowledge on this subject will be able to modify it according to demand.

Additionally, since the heating unit 250 is movably connected to the duct 211, the heating unit 250 may be replaced by another heating unit with different heating powers or different configurations, such that the heating system is able to supply air flow at different temperatures without modifying the other elements and devices whereby decreasing manufacturing cost.

Figure 2:
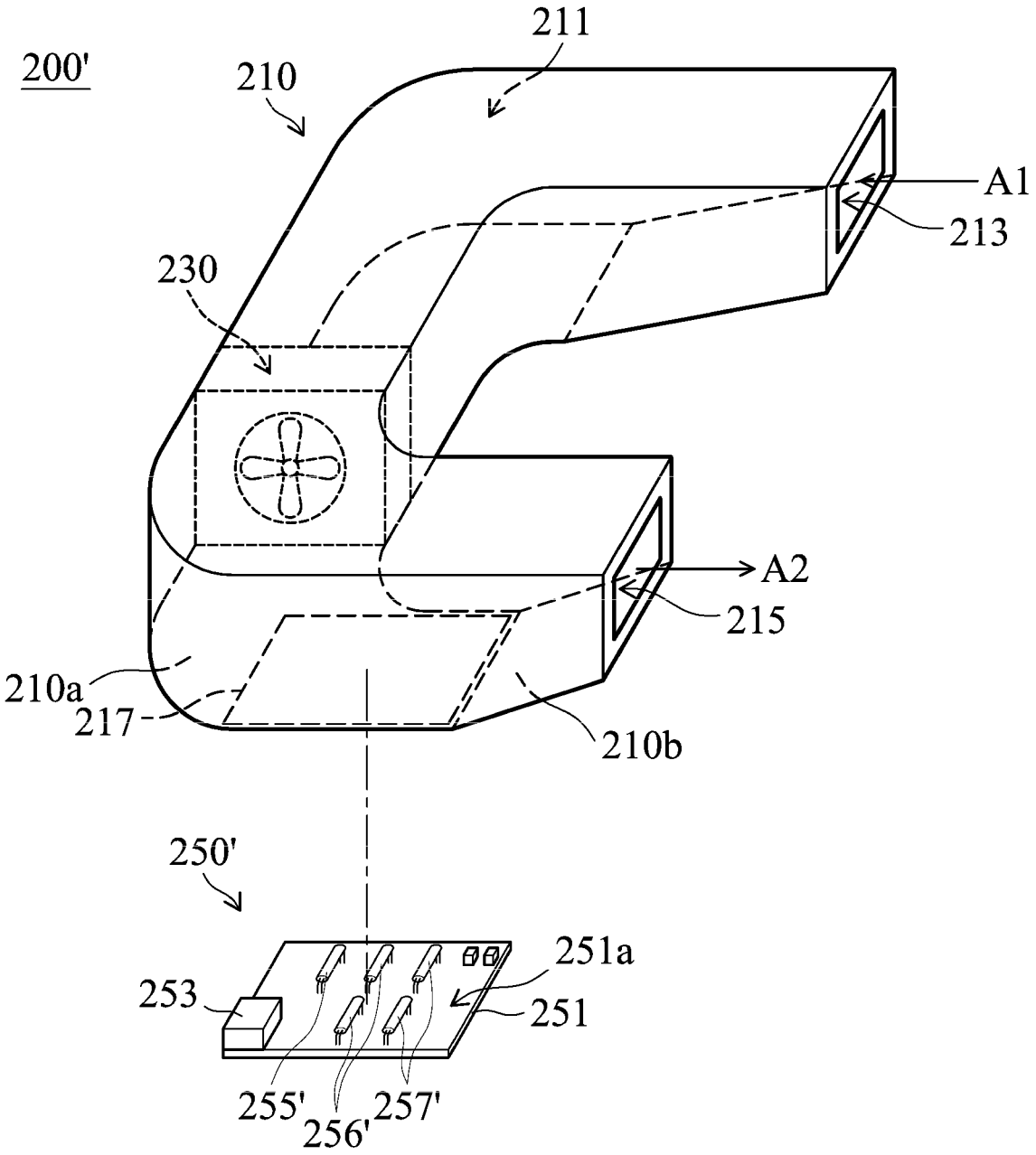
FIG. 2 shows an explosive view of a heating system of another embodiment of the disclosure.

Referring to FIG. 2, which shows an explosive view of a heating system 200' of another embodiment of the disclosure, since elements similar with that of the heating system 200 shown in FIG. 1 are provided with the same reference numbers, thus, the features thereof are not reiterated in the interest of brevity. The heating system 200' differs from the heating system 200' in that the heating system 200 includes a heating unit 250', which includes a plurality of electronic components 255', 256' and 257' disposed on the printed circuit board 251 in a lying manner, such that the contact area between the plurality of electronic components 255', 256' and 257' and the air flow is effectively increased whereby increasing heat exchange capacity.

The heating system of the disclosure uses the resistor elements as heating sources so that the manufacturing cost of the heating system may decrease. Additionally, due to the fact that the heat energy generated from the heating unit is directly transferred to the air flow, no medium is necessary to conduct the heat generated from the heating unit to the air flow, and the heat exchange efficiency is improved. Moreover, compared with the conventional heating device which uses a resistive heating plate as a heat source, the heating unit of the disclosure is compatible to different types of heating systems with variant functions by adjusting the configuration of the heating unit.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A heating unit, comprising:

a substrate; and a plurality of electronic components, disposed on the substrate in a matrix form and embossed from a surface of the substrate, wherein each of the plurality of electronic components is capable of individually producing heat to directly heat up air around the electronic components;

wherein the substrate comprises a printed circuit board which has a first edge and a second edge, and the plurality of electronic components is arranged on the printed circuit board along a direction from the first edge to the second edge; and wherein the plurality of electronic components has different heating powers, and along the direction from the first edge to the second edge the heating powers are adaptively adjusted according to heating requirements.

2. The heating unit as claimed in claim 1, wherein the plurality of electronic components is disposed on the substrate in an erected manner.

3. The heating unit as claimed in claim 1, wherein the plurality of electronic components is disposed on the substrate in a lying manner.

4. The heating unit as claimed in claim 1, wherein the plurality of electronic components is resistor elements.

5. A heating system, comprising:

a main body, having a duct with an air inlet and an air outlet;

an airflow guiding member, disposed in the duct and configured to activate air flow in the duct to flow; and a heating unit, comprising:

a substrate; and a plurality of electronic components, disposed on the substrate in a matrix form and embossed from a surface of the substrate, wherein each of the plurality of electronic components is capable of individually producing heat to directly heat up air flowing in the duct;

wherein the substrate comprises a printed circuit board which has a first edge and a second edge, wherein the second edge is close to the air outlet relative to the first edge, and the plurality of electronic components is arranged on the printed circuit board along a direction from the first edge to the second edge.

6. The heating system as claimed in claim 5, wherein the duct comprises a sidewall located between the airflow guiding member and the air outlet, and an opening is disposed on the sidewall, wherein the plurality of electronic components is disposed into the duct via the opening.

7. The heating system as claimed in claim 5, wherein the plurality of electronic components has different heating powers, and along the direction from the first edge to the second edge the heating power of each of the plurality of electronic components increases.

8. The heating system as claimed in claim 5, wherein the plurality of electronic components has different heating powers, and along the direction from the first edge to the second edge the heating powers are adaptively adjusted according to heating requirements.

9. A heating unit, comprising:

a substrate; and a plurality of electronic components, disposed on the substrate in a matrix form and embossed from a surface of the substrate, wherein each of the plurality of electronic components is capable of individually producing heat to directly heat up air around the electronic components;

wherein the substrate comprises a printed circuit board which has a first edge and a second edge, and the plurality of electronic components is arranged on the printed circuit board along a direction from the first edge to the second edge; and wherein the plurality of electronic components has different heating powers, and along the direction from the first edge to the second edge the heating power of each of the plurality of electronic components increases.

10. The heating unit as claimed in claim 9, wherein the plurality of electronic components is disposed on the substrate in an erected manner.

11. The heating unit as claimed in claim 9, wherein the plurality of electronic components is disposed on the substrate in a lying manner.

12. The heating unit as claimed in claim 9, wherein the plurality of electronic components is resistor elements.

* * * * *

UNITED STATES PATENT AND TRADEMARK OFFICE

CERTIFICATE OF CORRECTION

PATENT NO. : 9,279,599 B2
APPLICATION NO. : 13/950225
DATED : March 8, 2016
INVENTOR(S) : Yung-Lung Lee It is certified that error appears in the above-identified patent and that said Letters Patent is hereby corrected as shown below:

ON THE TITLE PAGE

Item (71)

Applicant should read: Lite-On Technology Corporation, Taipei (TW)

Signed and Sealed this
Thirty-first Day of May, 2016

Michelle K. Lee

Michelle K. Lee
*Director of the United States Patent and Trademark Office*